US008678491B2

(12) United States Patent
Chen et al.

(10) Patent No.: US 8,678,491 B2
(45) Date of Patent: Mar. 25, 2014

(54) HOOK-ON CHAIR WITH CLAMPING DISPLAY MECHANISM

(75) Inventors: Ho-Sheng Chen, Xingang Township, Chiayi County (TW); Lung-Sheng Chen, Sinshih Township, Tainan County (TW); Chiung-Li Chen, Taichung (TW); Kuang-Neng Cheng, Dalin Township, Chiayi County (TW)

(73) Assignee: Lerado (Zhong Shan) Industrial Co., Ltd, Guang Dong Province (CN)

( * ) Notice: Subject to any disclaimer, the term of this patent is extended or adjusted under 35 U.S.C. 154(b) by 270 days.

(21) Appl. No.: 13/193,613

(22) Filed: Jul. 29, 2011

(65) Prior Publication Data

US 2012/0026000 A1 Feb. 2, 2012

(30) Foreign Application Priority Data

Jul. 29, 2010 (CN) ..... 2010 2 0276295 U

(51) Int. Cl.
*A47D 1/10* (2006.01)

(52) U.S. Cl.
USPC ..... 297/174 CS; 297/134; 297/174 R

(58) Field of Classification Search
USPC ..... 297/134, 174 R, 174 CS, 463.1
See application file for complete search history.

(56) References Cited

U.S. PATENT DOCUMENTS

| | | | | |
|---|---|---|---|---|
| 2,710,643 | A * | 6/1955 | Wincey et al. | 297/174 CS |
| 4,818,016 | A * | 4/1989 | Mariol et al. | 297/174 CS |
| 4,863,216 | A * | 9/1989 | Prescott | 297/174 CS |
| 5,480,211 | A * | 1/1996 | Douglas et al. | 297/174 CS |
| 6,273,503 | B1 * | 8/2001 | Cheng | 297/174 CS |
| 6,679,549 | B2 * | 1/2004 | Catelli | 297/174 CS |
| 7,651,161 | B2 * | 1/2010 | Anselmi et al. | 297/174 CS |
| 2008/0296944 | A1 * | 12/2008 | Nakagawa et al. | 297/250.1 |
| 2010/0140997 | A1 * | 6/2010 | Biaud et al. | 297/250.1 |

* cited by examiner

*Primary Examiner* — Philip Gabler
(74) *Attorney, Agent, or Firm* — CKC & Partners Co., Ltd.

(57) ABSTRACT

In the specification and drawing, a hook-on chair is described and shown with a clamping mechanism and a display mechanism, wherein the display mechanism is positioned to reflect a clamping or loosing situation of the clamping mechanism.

12 Claims, 11 Drawing Sheets

HOOK-ON CHAIR WITH CLAMPING DISPLAY MECHANISM

RELATED APPLICATIONS

The application claims priority to China Application Serial Number 201020276295.2, filed Jul. 29, 2010, which is herein incorporated by reference.

BACKGROUND

1. Technical Field

The present disclosure relates to a hook-on chair. More particularly, the present disclosure relates to a hook-on chair with a clamping display mechanism.

2. Description of Related Art

Due to body limitation, a young child cannot have meals with adults normally. In addition to a high-dining chair, a hook-on chair may be directly clamped to a tabletop plate for enabling a light-weighted young child to take part in the family dinning activities. As shown in FIG. 1, a traditional hook-on chair includes a supporting skeleton 1 and a seat part 14. The supporting skeleton 1 includes an upper supporting frame 11, a lower supporting frame 12 and a clamping mechanism 13. The seat part 14 is connected with the upper supporting frame 11 of the supporting skeleton 1. The upper supporting frame 11 is against the top surface of the tabletop plate 10. The lower supporting frame 12 is against the bottom surface of the tabletop plate 10. The clamping mechanism 13 is connected with the lower supporting frame 12 and cooperates with the upper supporting frame 11 to clamp the tabletop plate 10, so that the supporting skeleton 1 can support the weight of the young child. The operator determines whether the clamping mechanism 13 has sufficiently clamped against the tabletop plate only through self-sensation, and since the operating manner of each operator is different, it is difficult to ensure whether the supporting is firm. China patent ZL200820117335.1 discloses a children's hook-on chair with a quick-releasing halving device, wherein a user may pull a lower retainer plate to stop an axle hole of the lower retainer plate from blocking a vertical shaft lever, so that the vertical shaft lever can move up and down quickly, thereby realizing an effect of clamping to or moving away from the tabletop plate. The hook-on chair for young children has advantages of convenience and swiftness, but is disadvantageous in that it has no warning display mechanism, so that it is impossible to determine whether the clamping mechanism has been completely fixed to the tabletop plate or not.

SUMMARY

The present disclosure aims to providing a hook-on chair with a clamping display mechanism, wherein the display mechanism enables an operator to determine whether a skeleton is clamped to a tabletop plate or not conveniently.

The hook-on chair with the clamping display mechanism according to one embodiment of the present disclosure includes:

a supporting skeleton for connecting with a tabletop plate;

a seat part connected with the supporting skeleton for providing a seating space;

a clamping mechanism connected with the supporting skeleton for connecting the supporting skeleton to a side edge of the tabletop; and a display mechanism connected with an upper end of the supporting skeleton for moving according to the clamping level of the clamping mechanism so as to reflect a clamping or loosing situation of the clamping mechanism.

Moreover, the supporting skeleton includes an upper supporting frame and a pair of lower supporting rods; the seat part is connected with one side of the upper supporting frame and the other side of the upper supporting frame is against a top surface of the tabletop plate; and one end of each of the lower supporting rods is connected with the upper supporting frame and the other end of each of the lower supporting rods is against a bottom surface of the tabletop plate. The clamping mechanism is disposed between the lower supporting rods and the upper supporting frame, so as to clamp against the tabletop plate. An anti-slip pad is connected with an end portion of the upper supporting frame, and a dinner plate is connected with the upper supporting frame and disposed at a position relative to the seat part. The display mechanism is disposed on the upper supporting frame for displaying the clamping situation of the clamping mechanism in a sliding manner or a rotating manner. The display mechanism includes a pushing block, a display block and a pressure element, wherein the pushing block is movably connected with the upper supporting frame, and under an un-clamped situation, one end of the pushing block is over a bottom surface of the upper supporting frame; the display block is disposed above the pushing block, and when the clamping mechanism is performing a clamping action against the tabletop plate, the pushing block pushes the display block, so as to display the clamping situation of the clamping mechanism; the pressure element is disposed between the display block and the pushing block, and the display block is slidably disposed in a display slot of the upper supporting frame, wherein an inner peripheral surface of the display slot of the upper supporting frame is provided with a first display area, an end surface of the display block is provided with a second display area, and when the first display area is completely covered by the display block, it is indicated that the clamping mechanism has clamped against the tabletop plate; and the first display area has a first color and the second display area has a second color. The display mechanism can also include a display block, a pushing block and a pressure element, wherein the display block is provided with a tilt long slot; the pushing block is pin-jointed with the tilt long slot; and the pressure element is disposed between the pushing block and the supporting skeleton. When the pushing block and the clamping mechanism move relative to the tabletop plate, the display block is driven through the tilt long slot, so as to reflect the clamping level of the clamping mechanism. The display block is provided with an indication area and the supporting skeleton is provided with a display area; and when the indication area moves towards or away from the display area, the clamping level of the clamping mechanism is indicated. The display mechanism can also include a display block and a pressure element, wherein the display block is pin-jointed with the supporting skeleton and is provided with a display end and a pushing end; the pressure element is disposed between the display block and the supporting skeleton; and when the clamping mechanism is clamping, the display block is driven to rotate, so as to reflect the clamping level of the clamping mechanism. The display end of the display block is provided with a warning area, and when the warning area is covered by the supporting skeleton, it is indicated that the clamping mechanism has completed clamping the tabletop plate.

The display mechanism may also include an inductive switch, a display block and an acousto-optic device, wherein when the clamping action is completed by the clamping mechanism, the display block moves accordingly to turn on the inductive switch, so that the acousto-optic device makes sound or emits light; and when the clamping mechanism is loosen some time after the clamping action is completed by the clamping mechanism, the display block moves backwards accordingly to turn on the inductive switch again, so that the acousto-optic device makes sound or emits light.

The hook-on chair with a clamping display mechanism provided by one or more embodiments of the present disclosure has the following advantages:

1. The display mechanism is disposed on the supporting frame, and the display mechanism can display the clamping situation of the clamping mechanism, so as to remind the operator of the supporting situation of the supporting mechanism and to take measures, thereby avoiding the seated young child from danger;

2. The display mechanism is provided with an acousto-optical device, which can make sound or emit light according to the clamping level of the clamping mechanism, so as to remind the operator whether the clamping mechanism is completely fixed or not;

3. The end portion of the upper supporting frame is connected with an anti-slip pad, which can avoid the supporting frame from slipping and is beneficial to fix the supporting frame onto the tabletop.

DETAILED DESCRIPTION

Figure 1:
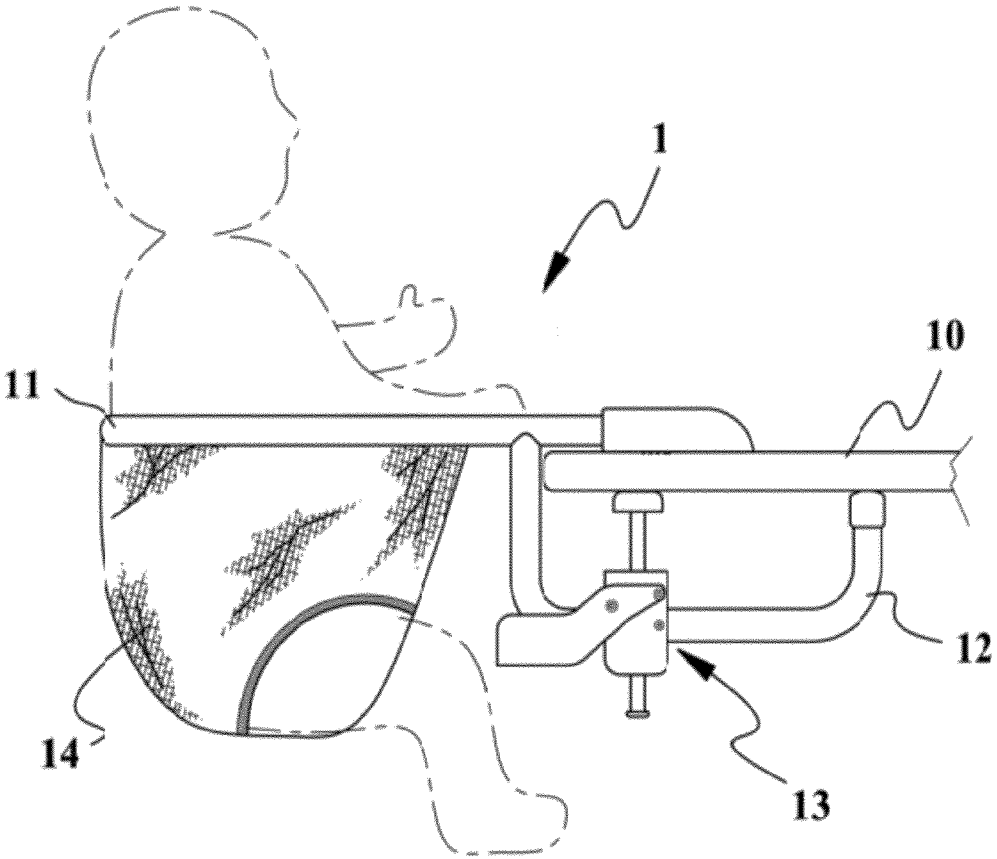
FIG. 1 is a schematic side view of a traditional hook-on chair.
Figure 2:
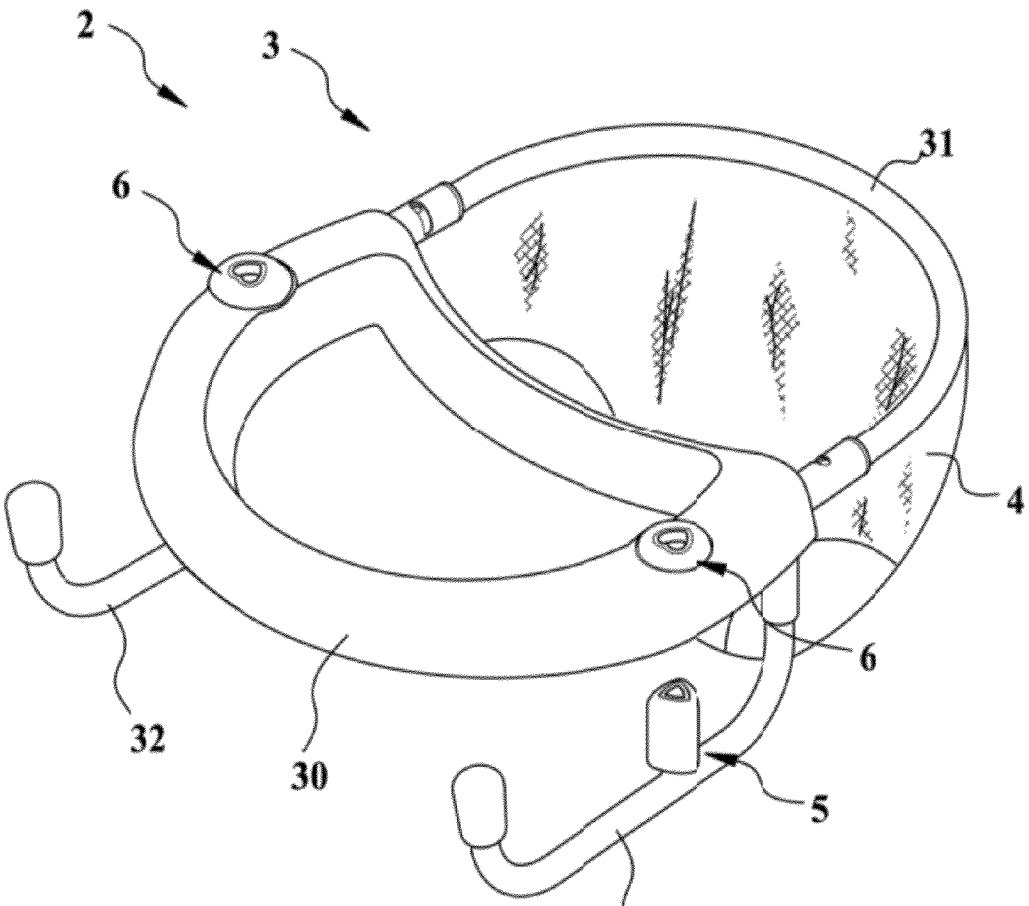
FIG. 2 is a schematic perspective view of a hook-on chair according to one embodiment of the present disclosure.

A hook-on chair with a clamping display mechanism has a structure as follows:

As shown in FIG. 2, a young-child hook-on chair 2 includes a supporting skeleton 3, a seat part 4 and a clamping mechanism 5. The hook-on chair 2 is installed to a side edge of a general table or chair. The supporting skeleton 3 is clamped to a side edge of a tabletop plate 90 through the clamping mechanism 5, and the seat part 4 is provided to a young child for seating to take part in meals. A display mechanism 6 is connected with the supporting skeleton 3, and the display mechanism 6 can reflect the completion situation of installation through color changes and warning sound or send out a warning if accidental loose happens after the clamping mechanism is clamped.

Figure 3:
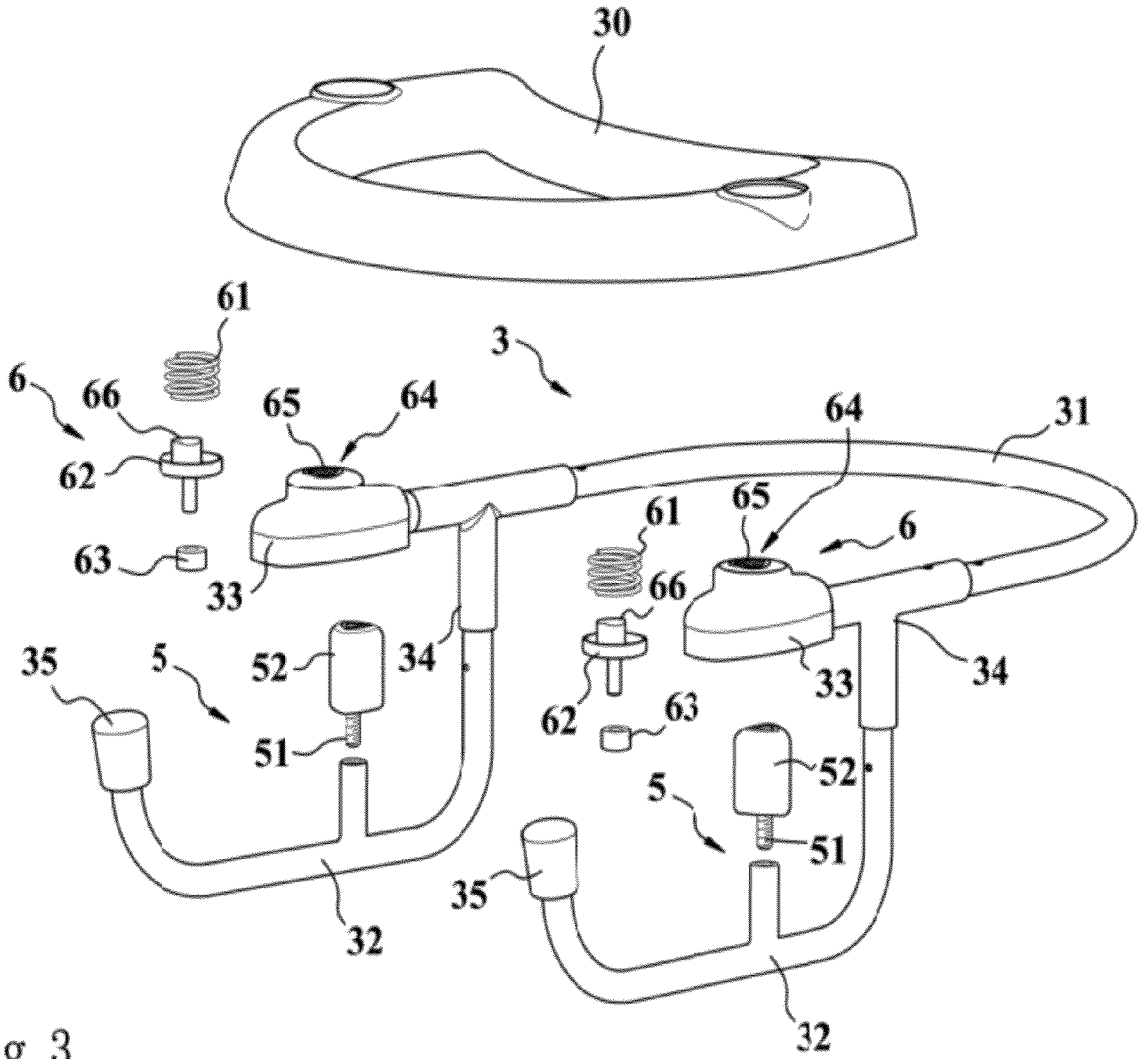
FIG. 3 is a schematic explosion perspective view of the hook-on chair of FIG. 2.

As shown in FIG. 3, an explosion view of the hook-on chair with the clamping display mechanism is shown. The supporting skeleton 3 includes an upper supporting frame 31 and a pair of lower supporting rods 32, wherein the upper supporting frame 31 is slightly U-shaped, and the two end portions of the upper supporting frame 31 are socket-jointed with anti-slip pads 33. A dinner plate 30 is connected with the supporting frame 31 and is placed in front of the seat part 4. The clamping mechanism 5 is placed at an appropriate position on the supporting rod 32 and can be realized through multiple known mechanisms. The clamping mechanism 5 includes lifting screws 51 and clamping blocks 52, wherein the lifting screws 51 are screw-jointed with the lower supporting rods 32 respectively; and the clamping blocks 52 are elastoplastic and integrated-built, and the clamping blocks 52 are connected with end portions of the lifting screws 51 respectively to move along the lifting screws 51. The display mechanism 6 includes pressure elements 61, display blocks 62 and pushing blocks 63, wherein the display blocks 62 are installed on the upper supporting frame 31, and in particular slidably disposed at two sides of the dinner plate 30 which has display slots 64 or disposed in the anti-slip pads 33. An inner peripheral surface of each of the display slots 64 has a first display area, and an end surface of each of the display blocks 62 has a second display area 66. The pushing blocks 63 are movably disposed at a position below the display blocks 62 respectively.

Figure 4:
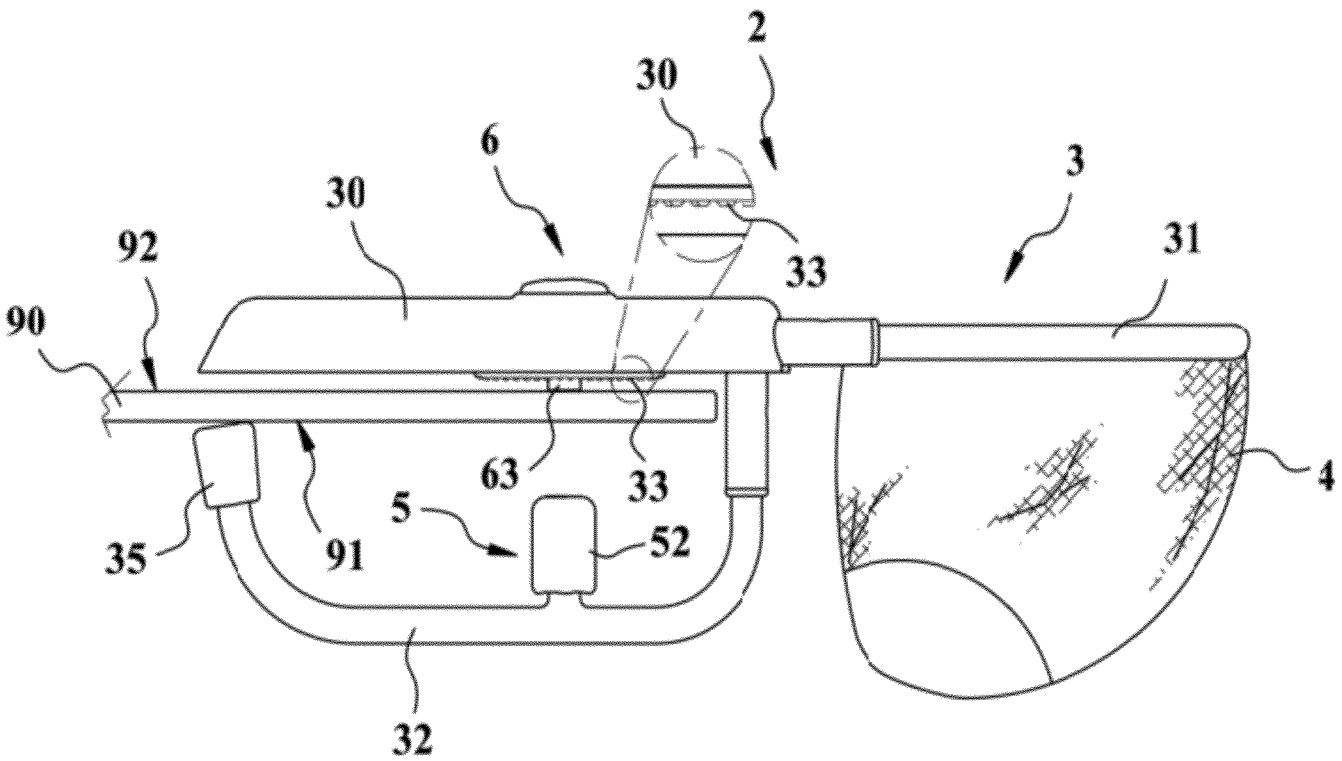
FIG. 4 is a schematic side view of the hook-on chair of FIG. 2.

As shown in FIG. 4, a schematic side view of the hook-on chair is shown. The anti-slip pads 33 socket jointed with the two end portions of the upper supporting frame 31 are positioned on the top surface 92 of the tabletop plate 90 for avoiding slipping and clamping against the tabletop plate 90 together with the clamping mechanism 5. The upper supporting frame 31 is connected with the seat part 4, so as to support the weight of a young child. The dinner plate 30 is disposed in front of the seat part 4 for holding food for the young child.

The lower supporting rods 32 are slightly L-shaped, and one end of each of the lower supporting rods 32 is connected at an appropriate position on the upper supporting frame 31 through a fixing end 34. The fixing end 34 is fixed through welding or riveting. The other end of each of the lower supporting rods 32 is a free end 35. Each of the lower supporting rod 32 extends downward and forward from the fixing end 34. When the lower supporting rods 32 are against the tabletop plate 90, the free ends 35 are located at an appropriate positions on the bottom surface 91 of the tabletop plate 90, so that if the clamping mechanism 5 is loosen, the free ends 35 temporarily prop at the bottom surface 91 of the tabletop plate 90, thereby avoiding the supporting skeleton 3 from falling down suddenly. The clamping mechanism 5 on the lower supporting rods 32 can clamp towards the bottom surface 91 by rotating the lifting screws 51, and the clamping mechanism 5 is fixed on the side edge of the tabletop plate 90 through the clamping blocks 52 together with the anti-slip pads 33 on the end portion of the upper supporting frame 31. The upper end of the seat part 4 is connected with a closed end of the upper supporting frame 31 through supporting wires, so as to provide seat for the young child; and the seat part 4 can be made by sewing materials of soft cloth or can be made of plastic with a soft cushion inside.

Figure 5:
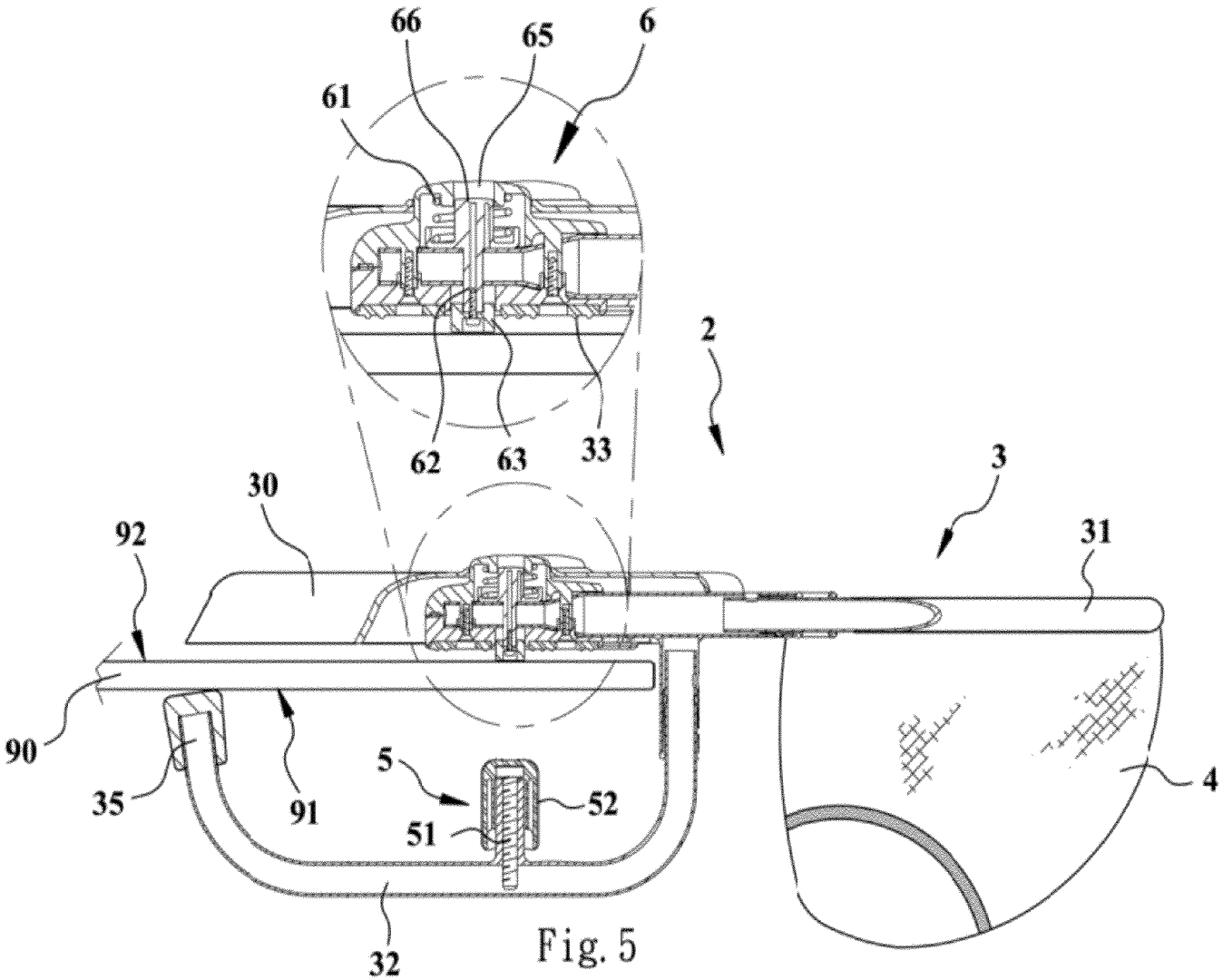
FIG. 5 is a schematic cross-sectional view of a display mechanism when a clamping mechanism is not clamped.

As shown in FIG. 5, FIG. 5 is a schematic cross-sectional view of a display mechanism when the clamping mechanism is not clamped. The display blocks 62 are installed on the upper supporting frame 31 and in particular are slidably disposed at two sides of the dinner plate 30 which has display slots 64 or installed in the anti-slip pads 33. The inner peripheral surface of each of the display slots 64 has a first display area 65, and the end surface of each of the display blocks 62 has the second display area 66. The pushing blocks 63 are movably disposed at positions below the display blocks 62 respectively, and when the tabletop plate 90 is not clamped, an end portion of each of the pushing blocks protrudes from the bottom surface of the upper supporting frame 31 and is in contact with the top surface 92 of the tabletop plate 90.

Figure 6:
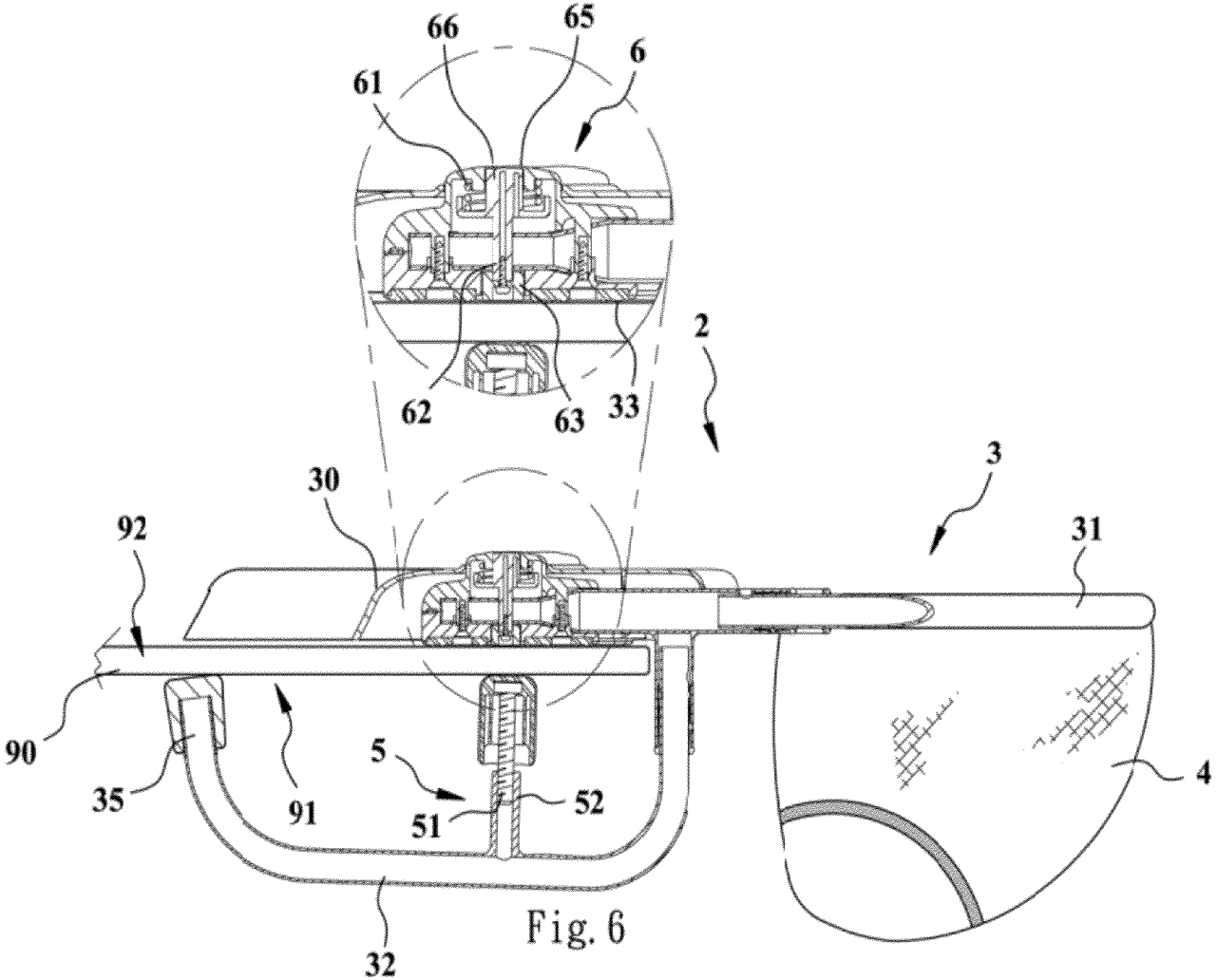
FIG. 6 is a schematic cross-sectional view of the display mechanism when the clamping mechanism is clamped.

The pressure elements 61 may be compression springs with a specific compression value or intensity, and are disposed between the display blocks 62 and the pushing blocks 63. When the supporting skeleton 3 is installed to the tabletop plate 90 of the dinner table, the end portions of the pushing blocks 63 are in contact with the top surface 92 of the tabletop plate 90, so that the operator can see the first display areas 65 at the peripheral surfaces of the display slots 64. When the operator is clamping with the clamping mechanism 5, as shown in FIG. 6, the bottom surface of the upper supporting frame 31, such as the bottom surface of the anti-slip pad 33, gradually clamps against the tabletop plate 90 together with the clamping blocks 52. During clamping, the pushing blocks 63 contracts inward accordingly and compresses the pressure elements 61; the pressure elements 61 and the pushing blocks 63 work together and push the display blocks 62 to move upward in the display slots 64, so as to cover the first display areas 65 gradually. When the display blocks 62 completely cover the first display areas 65, it is indicated that the clamping force is equal to the predetermined pressure value and is sufficient to support the supporting skeleton 3, and at this time the operator can only see the second display area 66.

Figure 7:
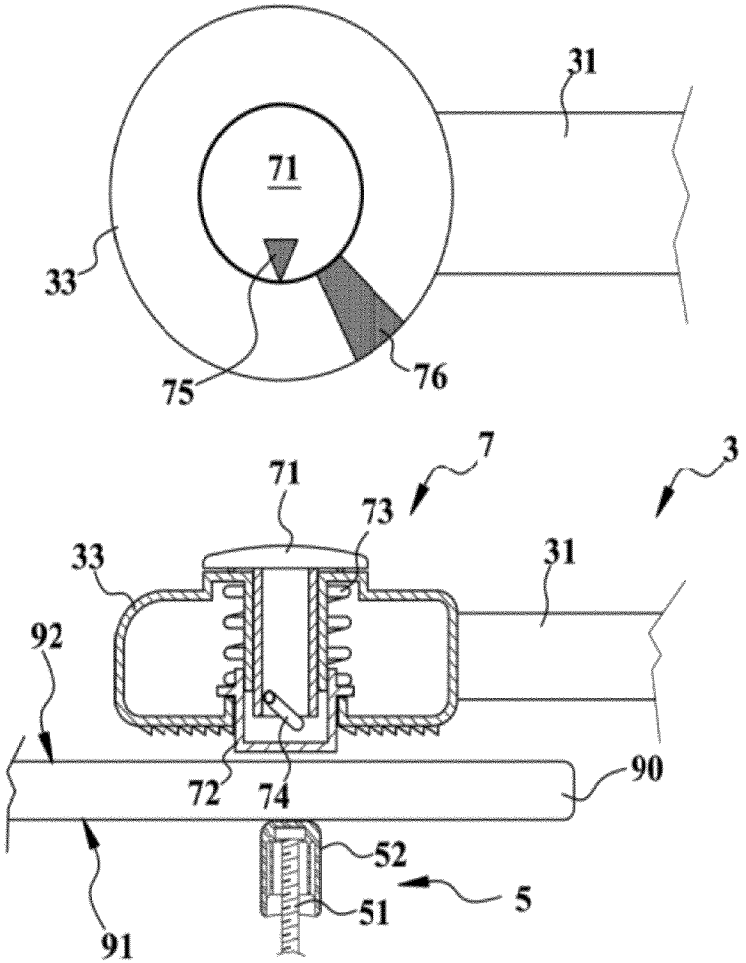
FIG. 7 is a schematic cross-sectional view of a second display mechanism when the clamping mechanism is not clamped.

FIG. 7 is a schematic cross-sectional view of a second display mechanism when the clamping mechanism is not clamped. The second display mechanism includes a display block 71, a pushing block 72 and a pressure element 73. The display block 71 and the pushing block 72 are socket-jointed with each other, and the display block 71 is provided with a tilt long slot 74 which is pin-jointed with the pushing block 72. When the tabletop plate 90 is not clamped, one end portion of the pushing block 72 protrudes from the upper supporting frame 31 and is in contact with the top surface 92 of the tabletop plate 90. The pressure element may be a compression spring and compressed in advance, and the pressure element is disposed between the pushing block 72 and the upper supporting frame 31.

When the clamping mechanism 5 is clamping towards the bottom surface 91 of the tabletop plate 90, the bottom surface of the upper supporting frame 31 or the bottom surfaces of the anti-slip pads 33 gradually clamps against the tabletop plate 90 together with the clamping blocks 52. During clamping, the pushing block 72 is forced to contract inward and push the pressure element 73. When the pushing block 72 is slipping relative to the display block 71, the display block rotates accordingly through pushing of the tilt long slot 74.

Figure 8:
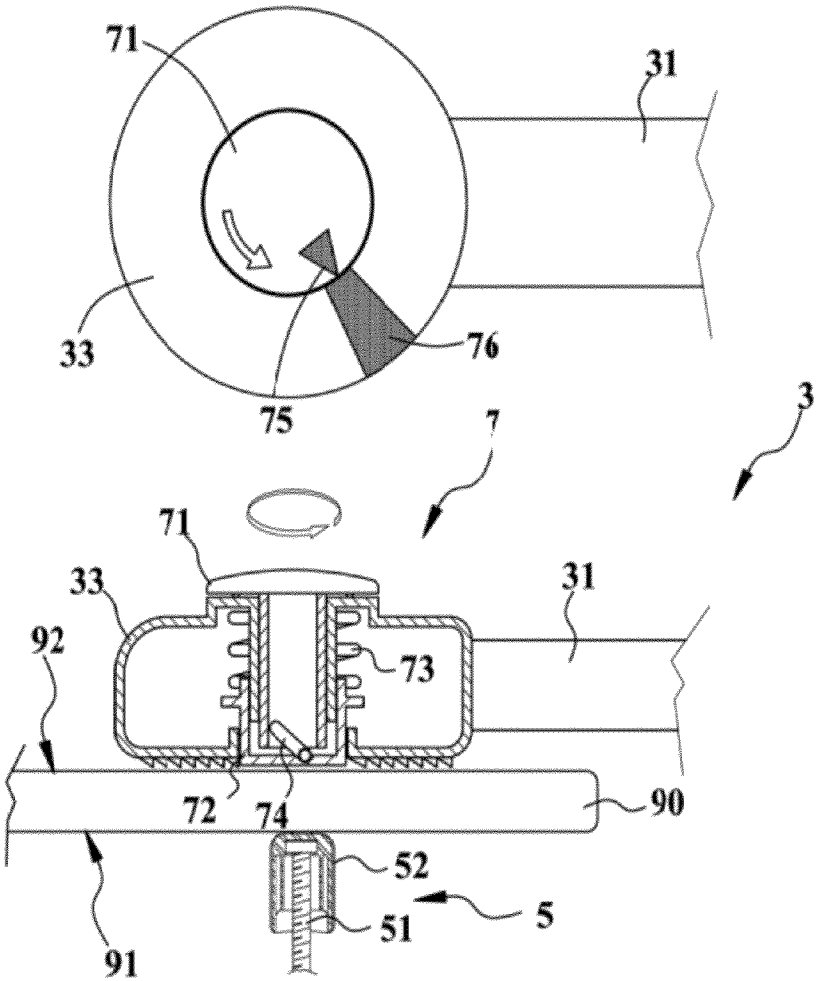
FIG. 8 is a schematic cross-sectional view of the second display mechanism when the clamping mechanism is clamped.

The display block 71 is provided with an indication area 75, and at least a display area 76 is disposed on the upper supporting frame 31 at a location relative to the indication area 75. When the clamping level reaches to the predetermined level, as shown in FIG. 8, the indication area 75 of the display block 71 rotates to the display area 76 of the upper supporting frame 31, so as to remind the operator that the clamping action is completed.

Figure 9:
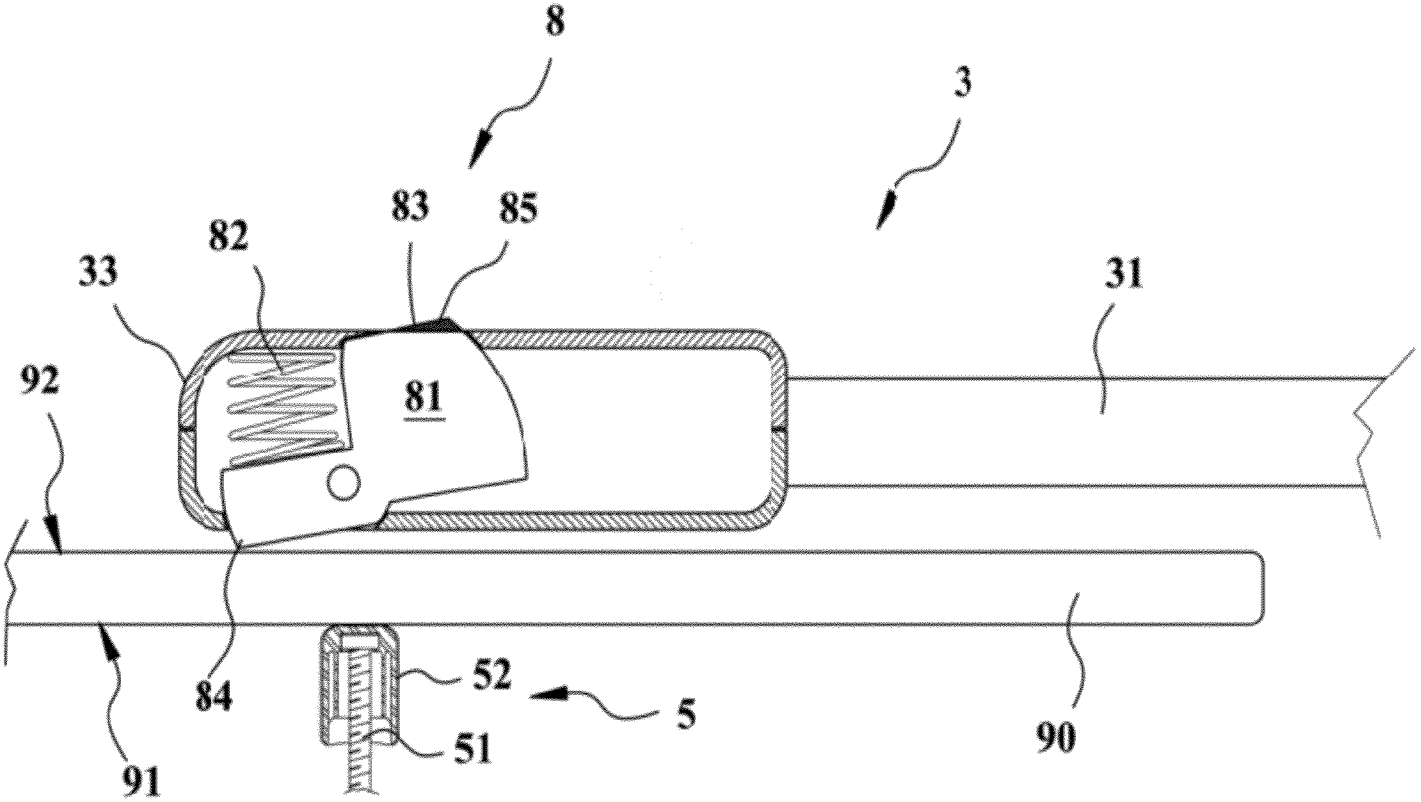
FIG. 9 is a schematic cross-sectional view of a third display mechanism when the clamping mechanism is not clamped.

FIG. 9 is a schematic cross-sectional view of a third display mechanism when the clamping mechanism is not clamped. The third display mechanism includes a display block 81 and a pressure element 82. The display block 81 includes a display end 83 and a pushing end 84, and the display block 81 is pin-jointed with the supporting skeleton 3. The pressure element 82 is disposed between the display block 81 and the supporting skeleton 3, so that when the clamping mechanism is not clamped, the pushing end 84 of the display block 81 is pushed over the bottom surface of the upper supporting frame 31 by the pressure element 82, and the display end 83 is also over the upper end surface of the upper supporting frame 31. The warning area 85 of the display end 83 reminds the operator that the clamping action is not completed.

Figure 10:
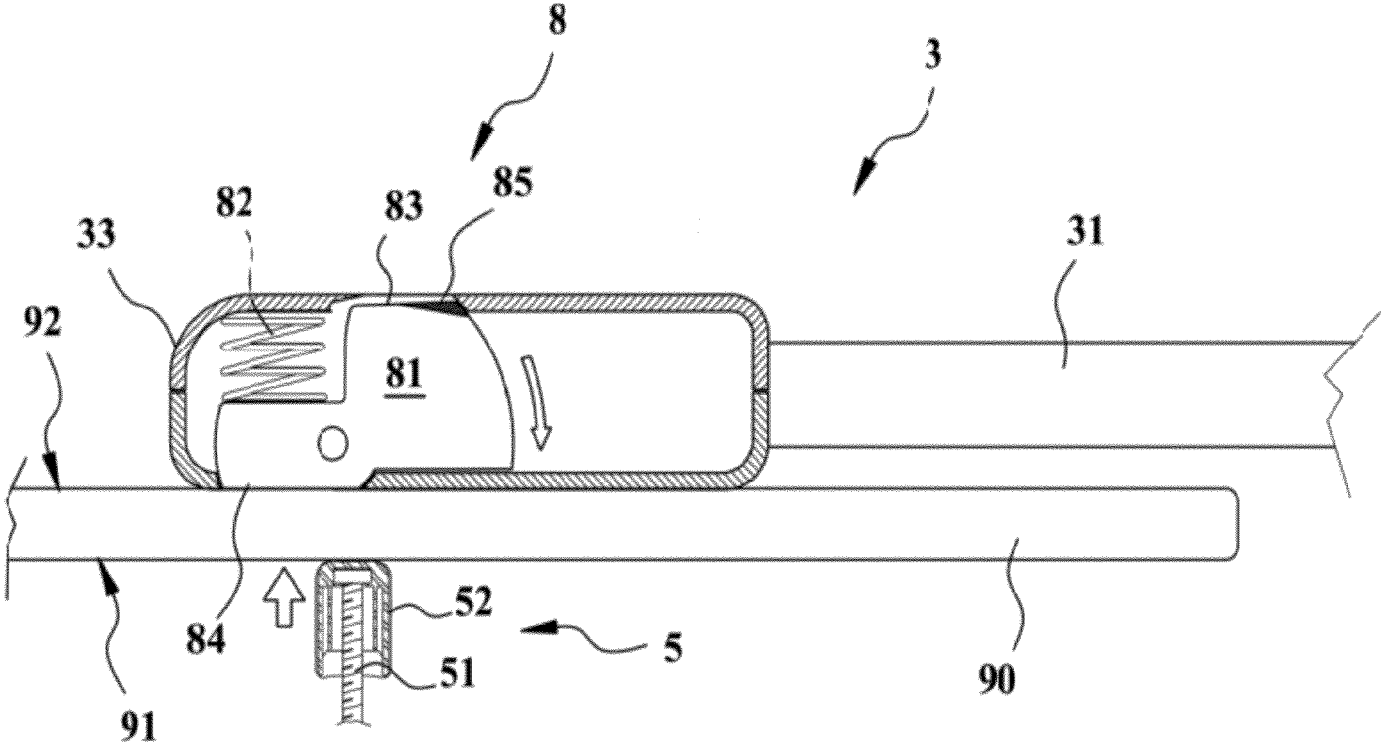
FIG. 10 is a schematic cross-sectional view of the third display mechanism when the clamping mechanism is not clamped.
Figure 11:
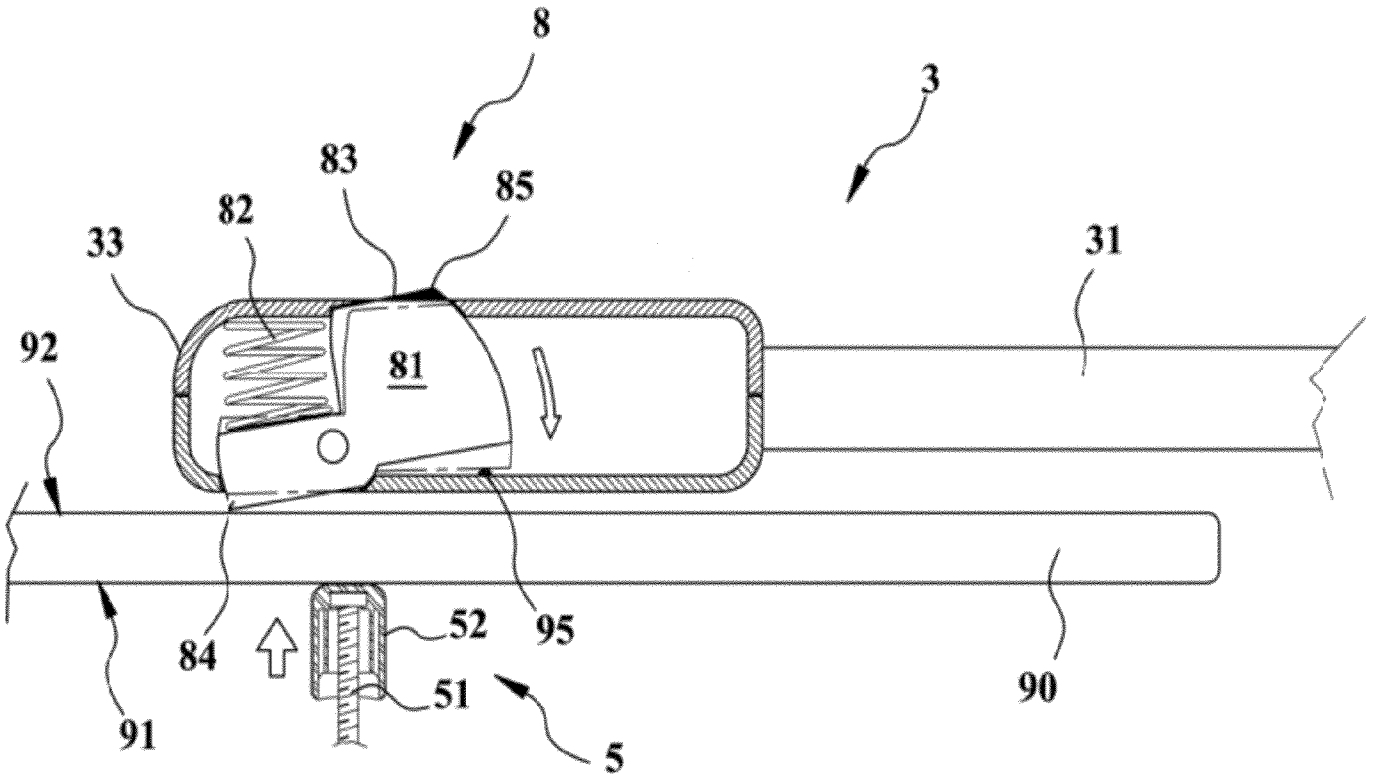
FIG. 11 is a schematic cross-sectional view of an inductive switch disposed on the display mechanism for controlling light and sound.

As shown in FIG. 10, when the operator uses the clamping mechanism 5 for clamping, the bottom surface of the upper supporting frame 31, such as the bottom surfaces of the anti-slip pads 33, gradually clamps against the tabletop plate 90 together with the clamping blocks 52, so that the display block 81 pivots and pushes the pressure element 82 when the clamping force gradually increases. When the clamping force reaches the predetermined value, the warning area 85 of the display end 83 is hidden in the upper supporting frame 31, so as to remind the operator that the clamping action is completed. Furthermore, the display mechanism 8 may include an inductive switch 95 and an acousto-optic device. As shown in FIG. 11, when the clamping mechanism 5 is clamping against the tabletop plate 90, the display block 81 rotates accordingly to finally turn on the inductive switch 95, which causes the acousto-optic device to make sound or emit light. When the clamping mechanism is loosen some time after the clamping action is completed by the clamping mechanism, the display block 81 moves backwards to turn on the inductive switch 95 to cause the acousto-optic device to make sound or emit light again, so as to remind the operator to check and clamp again.

The above-mentioned embodiments of the present disclosure provide the hook-on chair with the clamping display mechanism. When the operator uses the clamping mechanism 5 for clamping, the bottom surface of the upper supporting frame 31 or the bottom surfaces of the anti-slip pads 33 gradually clamps against the tabletop plate 90 together with the clamping blocks 52, and meanwhile, the clamping blocks 52 push the display mechanism to indicate different situations, so as to remind the operator whether the clamping mechanism has clamped against the tabletop or not, thereby protecting security of the seated young child.

What is claimed is:

1. A hook-on chair with a clamping display mechanism, comprising:

a supporting skeleton for connecting with a tabletop plate, the supporting skeleton comprising an upper supporting frame, wherein one side of the upper supporting frame is against a top surface of the tabletop plate;

a seat part connected with the other side of the upper supporting frame for providing a seating space;

a clamping mechanism connected with the supporting skeleton for connecting the supporting skeleton to a side edge of the tabletop plate; and a display mechanism connected with an upper end of the supporting skeleton for moving according to a clamping level of the clamping mechanism so as to reflect a clamping or loosing situation of the clamping mechanism the display mechanism comprising:

a pushing block movably connected with the upper supporting frame, wherein under an un-clamped situation, one end of the pushing block is over a bottom surface of the upper supporting frame;

a display block disposed above the pushing block, wherein when the clamping mechanism is performing a clamping action against the tabletop plate, the pushing block pushes the display block, so as to display the clamping situation of the clamping mechanism; and a pressure element disposed between the display block and the pushing block.

2. The hook-on chair with the clamping display mechanism of claim 1, wherein the supporting skeleton comprises a pair of lower supporting rods; one end of each of the lower supporting rods is connected with the upper supporting frame, and the other end of each of the lower supporting rods is against a bottom surface of the tabletop plate.

3. The hook-on chair with the clamping display mechanism of claim 2, wherein the clamping mechanism is disposed between the lower supporting rods and the upper supporting frame, so as to clamp against the tabletop plate.

4. The hook-on chair with the clamping display mechanism of claim 2, further comprising an anti-slip pad connected with an end portion of the upper supporting frame.

5. The hook-on chair with the clamping display mechanism of claim 2, further comprising a dinner plate connected with the upper supporting frame and disposed at a position relative to the seat part.

6. The hook-on chair with the clamping display mechanism of any of claims 2-5, wherein the display mechanism is disposed on the upper supporting frame for displaying the clamping situation of the clamping mechanism in a sliding manner.

7. The hook-on chair with the clamping display mechanism of any of claims 2-5, wherein the display mechanism is disposed on the upper supporting frame for displaying the clamping situation of the clamping mechanism in a rotating manner.

8. The hook-on chair with the clamping display mechanism of claim 1, wherein the display block is slidably disposed in a display slot of the upper supporting frame; an inner peripheral surface of the display slot of the upper supporting frame is provided with a first display area, and an end surface of the display block is provided with a second display area; and when the first display area is completely covered by the display block, it is indicated that the clamping mechanism has clamped against the tabletop plate.

9. The hook-on chair with the clamping display mechanism of claim 8, wherein the first display area has a first color and the second display area has a second color.

10. The hook-on chair with the clamping display mechanism of claim 1, wherein the display mechanism comprises an inductive switch and an acousto-optic device for making sound or emitting light when a clamping action is completed by the clamping mechanism.

11. The hook-on chair with the clamping display mechanism of claim 1, wherein the display mechanism comprises an inductive switch, a display block and an acousto-optic device, and when a clamping action is completed by the clamping mechanism, the display block moves accordingly to turn on the inductive switch, so that the acousto-optic device makes sound or emits light.

12. The hook-on chair with the clamping display mechanism of claim 11, wherein when the clamping mechanism is loosen some time after the clamping action is completed by the clamping mechanism, the display block moves backwards accordingly to turn on the inductive switch again, so that the acousto-optic device makes sound or emits light.

* * * * *